US006137278A

United States Patent [19]

Koffler et al.

[11] Patent Number: 6,137,278

[45] Date of Patent: Oct. 24, 2000

[54] CLAMPING CIRCUIT

[75] Inventors: Harald Koffler, Villach, Austria; Martin Feldtkeller, München, Germany

[73] Assignee: Siemens Aktiengesellschaft, Munich, Germany

[21] Appl. No.: 09/313,423

[22] Filed: May 17, 1999

[30] Foreign Application Priority Data

May 15, 1998 [DE] Germany ..... 198 21 906

[51] Int. Cl.[7] ..... G05F 3/16

[52] U.S. Cl. ..... 323/313

[58] Field of Search ..... 323/312, 313, 323/314; 327/535, 538, 539

[56] References Cited

U.S. PATENT DOCUMENTS

| | | | |
|---|---|---|---|
| 3,703,711 | 11/1972 | Duben | 340/173 FF |
| 4,764,897 | 8/1988 | Kameyama et al. | 365/154 |
| 4,823,315 | 4/1989 | Wood et al. | 365/155 |
| 4,926,073 | 5/1990 | Pigott et al. | 307/544 |
| 5,436,552 | 7/1995 | Kajimoto | 323/313 |
| 5,508,961 | 4/1996 | Han | 365/189.06 |
| 5,519,341 | 5/1996 | Corsi et al. . | |
| 5,576,616 | 11/1996 | Ridgers . | |
| 5,614,850 | 3/1997 | Corsi et al. | 327/55 |

FOREIGN PATENT DOCUMENTS

| | | |
|---|---|---|
| 2549575 | 5/1976 | Germany . |

*Primary Examiner*—Matthew Nguyen
*Attorney, Agent, or Firm*—Herbert L. Lerner; Laurence A. Greenberg; Werner H. Stemer

[57] ABSTRACT

A clamping circuit is described which prevents an input signal present on an input path from being able to assume a negative potential. The circuit is distinguished by a high voltage endurance in conjunction with accurate adherence to the clamping voltage and, at the same time, a low current consumption in the normal mode. The clamping circuit contains cross-coupled first and second transistors and can be changed over from a normal mode to a clamping mode if the voltage of the input signal falls below a predetermined clamping voltage, preferably 0 V. For this purpose, a third transistor is provided, which is connected into the input path in such a way that it is in a reverse conducting state in the clamping mode of the circuit and in a forward blocked state in the normal mode.

6 Claims, 3 Drawing Sheets

CLAMPING CIRCUIT

BACKGROUND OF THE INVENTION

Field of the Invention

The invention relates to a clamping circuit that has cross-coupled first and second transistors for generating a predetermined minimum voltage. The clamping circuit changes over from a normal mode to a clamping mode if a voltage of a signal fed via an input path falls below a predetermined clamping voltage.

Clamping circuits are generally used to keep the level of an applied signal at a specific minimum value. Such clamping circuits have acquired considerable importance in the application of integrated circuits. This is because if input signals drop into a region of a diode voltage that is below ground potential or less, it could cause currents to flow via the parasitic components that are present in every integrated circuit. These currents can interfere with neighboring components or even the entire function of the circuit. The risk is particularly high for example when a fault in the form of an interruption of a ground connection occurs in an electronic circuit configuration having a plurality of supply voltages and ground connections. Particularly in safety-critical applications (for example in electronic systems appertaining to automobile electronics), it must be ensured that the circuit sections which are not directly affected by the fault are not influenced.

In order to solve this problem, a circuit having four npn transistors and a current source, is known, for example. The first and second transistors, which each have a very steep output characteristic curve, are cross-coupled.

The emitter of the first transistor (output transistor) is connected to an input path on which the input signal to be monitored is present. Such a circuit makes it possible to obtain a good protective effect in the clamping mode, the desired clamping voltage being adhered to in a very accurate manner. However, the known circuit has the disadvantage that it is not suitable for operation with high input voltages (for example 40 V or more). This is due to the fact that the first transistor, which is an NPN transistor, has only a low capacity to withstand such positive input voltages on account of its relatively low emitter-base breakdown voltage.

To remedy this, it is known to make the circuit voltage-proof with a first diode between the emitter of the first transistor and the input path for the input voltage, and a second diode at the emitter of the second transistor being necessary for reasons of symmetry. As a result, the desired clamping voltage can be adhered to. However, this circuit has the disadvantage that the current-dependent forward voltage of the first diode distorts the clamping voltage and the protective effect is thus greatly impaired in the clamping mode. Although this problem can be partly resolved by increasing the current $I_{bias}$, the consequence of this measure is that the current through the first transistor actually increases before the predetermined clamping voltage is reached, and, as a result, the total current consumption of the clamping circuit in the normal mode also increases in an undesirable manner.

U.S. Pat. No. 5,519,341 discloses a comparator circuit with cross-coupled transistors, which detects the load current through a transistor by a source resistor and detects it to a predetermined current value. The current through the transistor can be limited by a flip-flop.

U.S. Pat. No. 5,576,616 likewise discloses an SA with cross-coupled transistors, which serves as a reference voltage source for an integrated circuit configuration, in which the supply potential may fluctuate. The circuit configuration specified is, moreover, insensitive to temperature fluctuations.

Published, Non-Prosecuted German Patent Application DE 25 49 575 A1 describes a circuit configuration with cross-coupled transistors, which is provided for connection to a specific current or voltage source. This circuit generates a signal that is independent of the current or voltage source.

SUMMARY OF THE INVENTION

It is accordingly an object of the invention to provide a clamping circuit, which overcomes the above-mentioned disadvantages of the prior art devices and methods of this general type, which has a high voltage endurance in conjunction with accurate adherence to a clamping voltage and, at the same time, a low current consumption in the normal mode.

With the foregoing and other objects in view there is provided, in accordance with the invention, a circuit configuration for generating a predetermined minimum voltage, including:

a clamping circuit, containing:

a first transistor;

a second transistor cross-coupled with the first transistor;

an input path connected to the first transistor, the clamping circuit changing over from a normal mode to a clamping mode if a voltage of a signal fed via the input path falls below a predetermined clamping voltage; and a third transistor connected into the input path such that the third transistor is in a reverse conducting state in the clamping mode and in a forward blocked state in the normal mode.

The object is achieved by a clamping circuit of the type mentioned in the introduction which is distinguished by a third transistor, which is connected into the input path in such a way that it is in the reverse conducting state in the clamping mode of the circuit and in the forward blocked state in the normal mode of the circuit.

The solution combines two essential advantages. By virtue of the fact that the current flows via the low-impedance channel and not via the reverse diode of the transistor in the clamping mode, the protection function of the clamping circuit is not disrupted, on the one hand. In the normal mode, on the other hand, the third transistor protects the first transistor against excessively high voltages of the input signal, with the result that the desired voltage endurance of the clamping circuit can be obtained.

Accordingly, the third transistor is preferably a D-MOS field-effect transistor, whose gate terminal is connected to a supply voltage VDD for activating the field-effect transistor.

In order to at least partly compensate for the on resistance of the third D-MOS field-effect transistor, a fourth D-MOS field-effect transistor is preferably provided. The fourth transistor is connected into the emitter of a fifth transistor, which is connected to the supply voltage via a third diode, and a gate terminal of the third transistor is connected to a collector of the fifth transistor.

Furthermore, all of the transistors and also the third diode can be replaced by field-effect transistors in each case.

The clamping circuit is provided in particular for use in connection with integrated circuits, the clamping voltage being zero volts in this case. Moreover, the clamping circuit can be realized in particular using BICDMOS (Bipolar, C- and D-MOS) technology.

Other features which are considered as characteristic for the invention are set forth in the appended claims.

Although the invention is illustrated and described herein as embodied in a clamping circuit, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
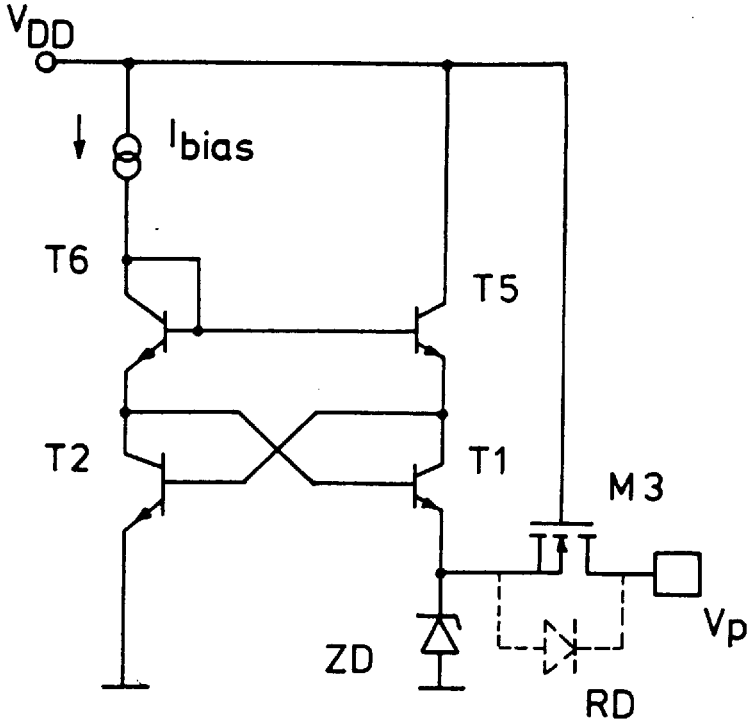
FIG. 1 is a diagrammatic, circuit diagram of a first embodiment according to the invention.

In all the figures of the drawing, sub-features and integral parts that correspond to one another bear the same reference symbol in each case. Referring now to the figures of the drawings in detail and first, particularly, to FIG. 5*a* thereof, there is shown a prior art clamping circuit. The clamping circuit has four npn transistors T1, T2, T5, T6 and a current source $I_{bias}$. The first and second transistors T1 and T2, which each have a very steep output characteristic curve, are cross-coupled.

The emitter of the first transistor T1 (output transistor) is connected to an input path $V_p$ on which the input signal to be monitored is present. Such a circuit makes it possible to obtain a good protective effect in the clamping mode, the desired clamping voltage being adhered to in a very accurate manner. However, the known circuit has the disadvantage that it is not suitable for operation with high input voltages (for example 40 V or more). This is due to the fact that the first transistor T1, which is an NPN transistor, has only a low capacity to withstand such positive input voltages on account of its relatively low emitter-base breakdown voltage.

Figure 5A:
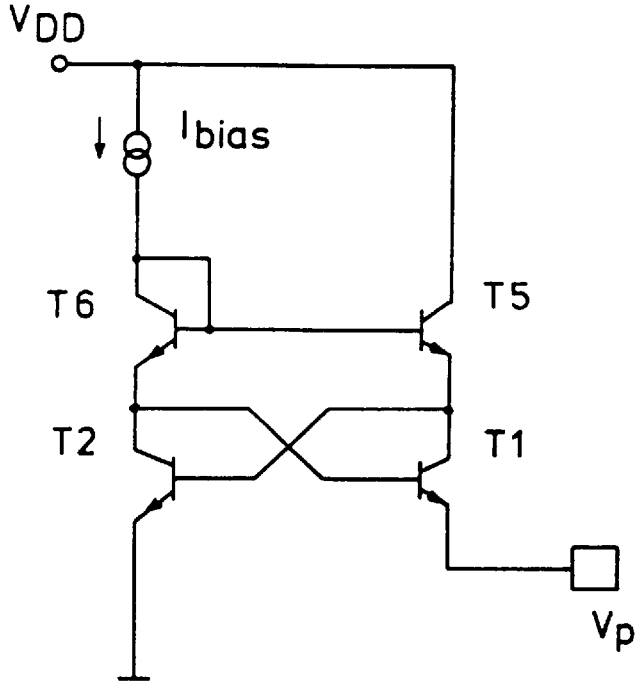
FIG 5a Prior Art
FIGS. 5*a* and 5*b* are circuit diagrams of a clamping circuit in accordance with the prior art.
Figure 5B:
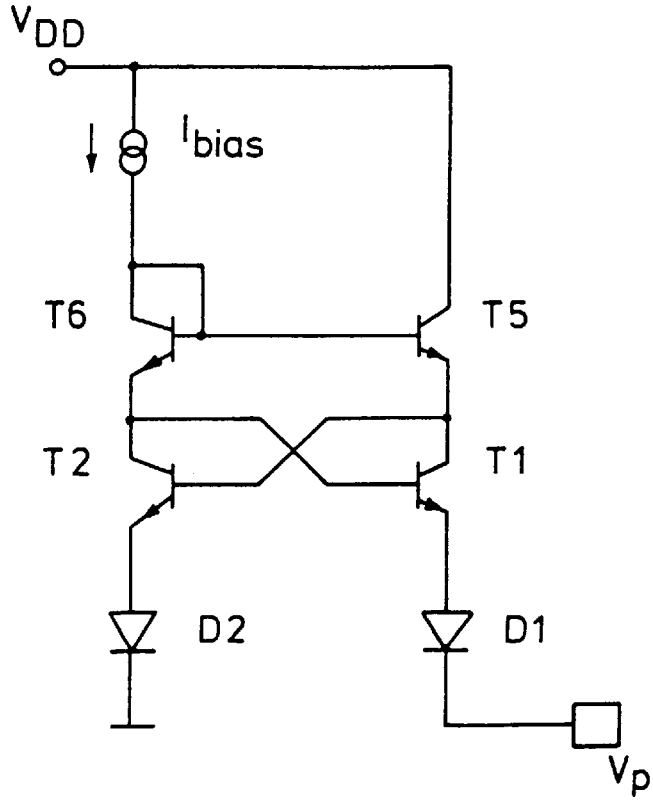
FIG 5b Prior Art

To remedy this, it is known to make the circuit shown in FIG. 5*a* voltage-proof, in accordance with FIG. 5*b*, with a first diode D1 between an emitter of the first transistor T1 and the input path $V_p$ for the input voltage, and a second diode D2 at an emitter of the second transistor T2 being necessary for reasons of symmetry. As a result, the desired clamping voltage can be adhered to. However, the circuit has the disadvantage that the current-dependent forward voltage of the first diode D1 distorts the clamping voltage and the protective effect is thus greatly impaired in the clamping mode. Although the problem can be partly resolved by increasing the current $I_{bias}$, the consequence of the measure is that the current through the first transistor T1 actually increases before the predetermined clamping voltage is reached, and, as a result, the total current consumption of the clamping circuit in the normal mode also increases in an undesirable manner.

By contrast, FIG. 1 shows a first embodiment of a circuit according to the invention, which has a third transistor M3 in the form of a normally off n-channel insulated gate field-effect transistor (D-MOS-FET), which is connected into the input path $V_p$ of the clamping circuit and whose gate is connected to a positive supply voltage VDD which suffices to turn the latter on completely (for example 5 V). A reverse diode RD of the field-effect transistor M3 is indicated by dashed lines. Finally, a zener diode ZD is connected between the emitter of the first transistor T1 and ground.

In the normal mode with a positive input voltage, the field-effect transistor M3 is in the forward blocked mode and consequently protects the first transistor T1 of the clamping circuit against excessively high input voltages. The zener diode ZD prevents impermissible charging of the emitter of the first transistor T1 by the reverse current flowing via the switched-off field-effect transistor M3.

If the input voltage present on the input path $V_p$ drops to ground potential, then the field-effect transistor M3 changes to the reverse conducting state, and the circuit goes into the clamping mode. In the clamping mode the input signal is connected to ground via the first and second transistors T1, T2 and, consequently, a further drop in the input voltage is prevented. In this case, the current flows via the low-impedance channel of the field-effect transistor M3 and not via the reverse diode RD, with the result that the clamping voltage, unlike in the case of the circuit explained in the introduction with reference to FIG. 5*b*, is not distorted but rather remains uninfluenced. Consequently, the protection function of the clamping circuit is not impaired either.

Figure 2:
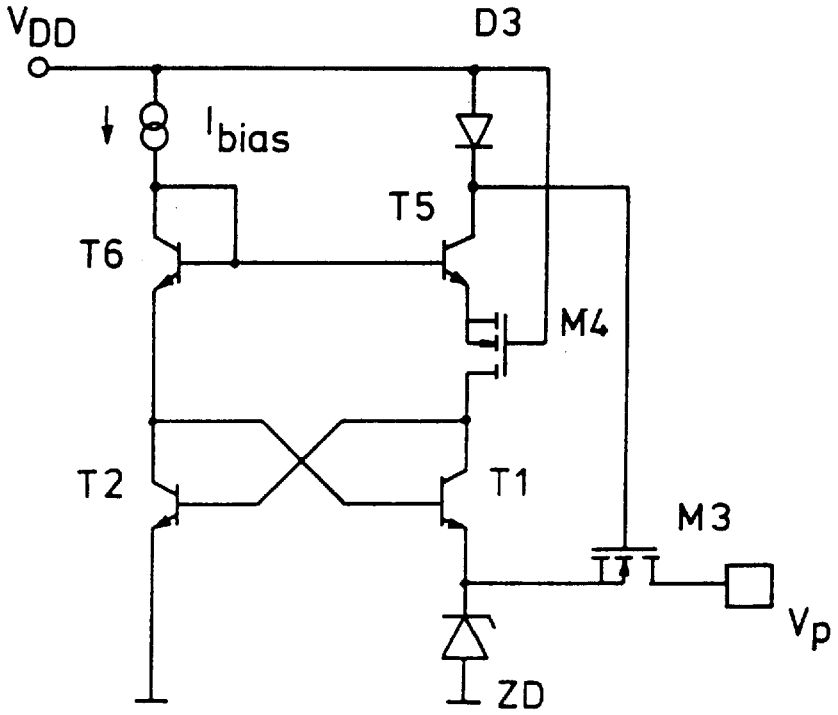
FIG. 2 is a circuit diagram of a second embodiment of the invention.

FIG. 2 shows a second embodiment of the invention, which, by comparison with the first embodiment, has a fourth transistor in the form of a D-MOS field-effect transistor M4 and also a third diode D3. The fourth transistor M4 is connected into an emitter of the fifth transistor T5, while the third diode D3 is situated in a collector circuit of the fifth transistor T5.

The influence of the on resistance of the third transistor M3 (field-effect transistor) can be partly or completely compensated for by the second embodiment. For reasons of stability, the fourth transistor M4 must have a smaller or identical on resistance to that of the third transistor M3. This pairing property can be produced, in particular, by the two field-effect transistors M3 and M4 being operated under identical conditions. This is achieved by the third diode D3 connected into the collector circuit, by inverse operation of the fourth transistor M4 and also by virtue of the fact that the gate terminal of the third transistor M3 is connected between the third diode D3 and the collector of the fifth transistor T5.

Furthermore, the second embodiment has the advantage that the input voltage present on the input path $V_p$ is limited more accurately than in the first embodiment in accordance with FIG. 1. If the voltage drop across the fourth transistor M4 becomes so great that the first transistor T1 reaches saturation, the current flow via the first and fifth transistors T1, T5 cannot rise further, and the output voltage drops.

Figure 3:
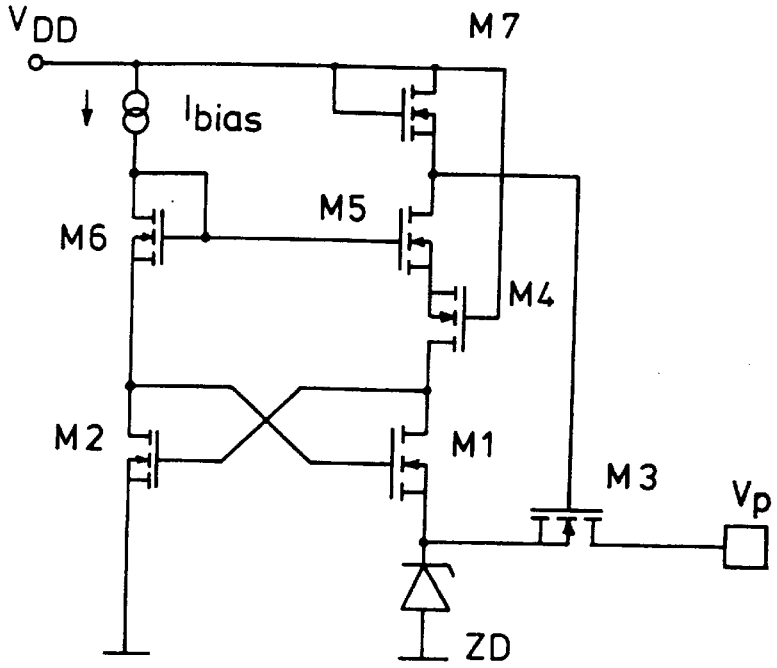
FIG. 3 is a circuit diagram of a third embodiment of the invention.

FIG. 3 shows a third embodiment of the invention. This differs from the second embodiment shown in FIG. 2 by virtue of the fact that the transistors T1, T2, T5 and T6 and also the third diode D3 are in each case replaced by n-channel insulated gate field-effect transistors (MOS) M1, M2, M5, M6 and M7, respectively. For reliable operation of the circuit, it is necessary that the first and fifth transistor M1, M5 each have the same transfer characteristic curve.

Since the inverse diode of the fourth transistor M4 begins to conduct before the drain-source voltage of the first transistor M1 becomes too small, the circuit does not have the same current limiting effect as the second embodiment shown in FIG. 2. Only when the drain-source voltage of the first transistor M1 is lower than that of the fifth transistor M5 so that the transfer characteristic curves of the two transistors differ from one another does the output voltage decrease slowly with an increasing magnitude of the output current.

Figure 4:
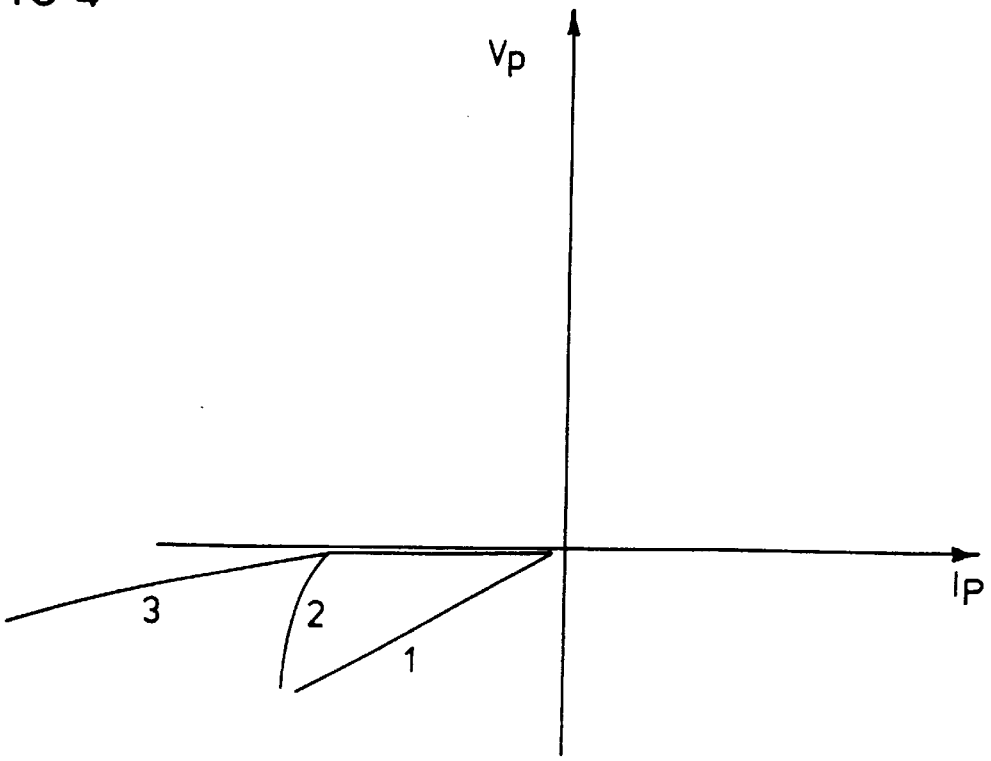
FIG. 4 is a graph of output characteristic curves of the circuits shown in FIGS. 1 to 3.

Finally, FIG. 4 shows output characteristic curves 1, 2 and 3 of the first, second and third embodiments, respectively, the output voltage being plotted on the vertical axis and the output current being plotted on the horizontal axis.

We claim:

1. A circuit configuration for generating a predetermined minimum voltage, comprising:

a clamping circuit, including:

a first transistor;

a second transistor cross-coupled with said first transistor;

an input path connected to said first transistor, the clamping circuit changing over from a normal mode to a clamping mode if a voltage of a signal fed via said input path falls below a predetermined clamping voltage; and a third transistor connected into said input path such that said third transistor is in a reverse conducting state in the clamping mode and in a forward blocked state in the normal mode.

2. The clamping circuit according to claim 1, wherein said third transistor is a D-MOS field-effect transistor with a gate terminal to be connected to a supply voltage for activating said D-MOS field-effect transistor.

3. The clamping circuit according to claim 2, wherein said first transistor has an emitter, and including a zener diode connected to said emitter of said first transistor for preventing impermissible charging of said emitter by a reverse current flowing via said third transistor in a switched-off state of said third transistor.

4. The clamping circuit according to claim 2, including:

a fourth D-MOS field-effect transistor for at least partly compensating for an on resistance of said third transistor;

a fifth transistor having a collector and an emitter, said emitter of said fifth transistor connected to said fourth D-MOS field effect transistor;

a diode having a first side to be connected to the supply voltage and a second side connected to said fifth transistor; and said third transistor having a gate terminal connected to said collector of said fifth transistor.

5. The clamping circuit according to claim 4, wherein said first transistor, said second transistor, said fourth transistor, said fifth transistor and said diode are in each case a MOS field-effect transistor.

6. A method for using a circuit, which comprises:

providing a clamping circuit for generating a predetermined minimum voltage having a first transistor, a second transistor cross-coupled with the first transistor, an input path connected to the first transistor, the clamping circuit changing over from a normal mode to a clamping mode if a voltage of a signal fed via the input path falls below a predetermined clamping voltage, and a third transistor connected into the input path such that the third transistor is in a reverse conducting state in the clamping mode and in a forward blocked state in the normal mode; and using the clamping circuit in connection with an integrated circuit in which a clamping voltage is 0 volts.

* * * * *